United States Patent [19]

Morimoto

[11] 4,350,472

[45] Sep. 21, 1982

[54] ELECTRIC FAN APPARATUS

[75] Inventor: Masao Morimoto, Kasai, Japan

[73] Assignee: Sanyo Electric Co., Ltd., Moriguchi, Japan

[21] Appl. No.: 93,596

[22] Filed: Nov. 13, 1979

[30] Foreign Application Priority Data

| | | | |
|---|---|---|---|
| Nov. 14, 1978 | [JP] | Japan | 53-157845[U] |
| Mar. 14, 1979 | [JP] | Japan | 54-33343[U] |
| Mar. 19, 1979 | [JP] | Japan | 54-35849[U] |
| Mar. 23, 1979 | [JP] | Japan | 54-38447[U] |
| Mar. 26, 1979 | [JP] | Japan | 54-35826 |

[51] Int. Cl.[3] ..... F04D 29/56

[52] U.S. Cl. ..... 415/125; 415/121 G; 415/123; 415/150; 415/209; 98/40 V; 188/291

[58] Field of Search ..... 415/18, 121 G, 123, 415/125, 127, 62, 68, 146, 147, 216, 217, 150, 209; 416/124; 98/40 R, 40 V, 40 VM, 113, 116; 188/290, 291; 64/29 R

[56] References Cited

U.S. PATENT DOCUMENTS

| | | | |
|---|---|---|---|
| 910,760 | 1/1909 | Wood | 416/52 |
| 1,725,085 | 8/1929 | Johnson | 416/124 |
| 1,861,608 | 6/1932 | Persons | 415/125 |
| 1,990,801 | 2/1935 | Spear | 98/40 V |
| 2,124,716 | 7/1938 | Sperry | 98/40 V |
| 2,420,360 | 5/1947 | Deming | 188/290 X |
| 2,563,112 | 8/1951 | Hill et al. | 64/29 X |
| 2,824,429 | 2/1958 | Zucker | 98/120 X |
| 3,173,478 | 3/1965 | Maycen | 416/244 X |
| 3,481,534 | 12/1969 | Price | 415/146 |
| 4,123,197 | 10/1978 | Keem et al. | 417/423 R |

FOREIGN PATENT DOCUMENTS

| | | | |
|---|---|---|---|
| 101763 | 8/1937 | Australia | 415/125 |
| 459701 | 4/1971 | Australia | 417/234 |

*Primary Examiner*—Leonard E. Smith
*Attorney, Agent, or Firm*—Darby & Darby

[57] ABSTRACT

The present application discloses an electric fan apparatus comprising a fan, a wind direction shifting plate disposed in front of said fan and adapted to be rotated by the pressure of a wind generated by said fan, a rotary shaft disposed at the center of said wind direction shifting plate and adapted to be rotated integrally with said wind direction shifting plate, a speed governor mechanism interlocked with said rotary shaft and a housing box for housing said speed governor mechanism.

With said wind direction shifting plate rotated, a wind may be provided in a wide range. Provision is made to improve the durability of said speed governor mechanism, which is formed with a gear mechanism and a blade. Said housing box contains a liquid into which at least a portion of said gear mechanism is immersed, so that said wind direction shifting plate is rotated at a substantially constant low speed.

2 Claims, 30 Drawing Figures

ELECTRIC FAN APPARATUS

BACKGROUND OF THE INVENTION

In a conventional electric fan apparatus, a wind direction shifting plate has been used as means for shifting the direction of a wind generated by a fan rotated by a motor, without shifting the air sending direction by the fan. When a motor has been used for rotating such wind direction shifting plate, the rotation of the fan motor rotary shaft or the rotation of the rotary shaft of a motor to rotate the wind direction shifting plate has been transmitted to the rotary shaft of the wind direction shifting plate through a reduction gear mechanism, thereby to rotate the wind direction shifting plate at a low speed. In such arrangement, however, if the wind direction shifting plate is stopped rotating by external force, there is a possibility of the motor being burnt out. In addition, if the wind direction shifting plate is forcibly rotated from their stop position, there is a possibility of the reduction gear mechanism being damaged.

When the pressure of a wind generated by the fan has been utilized as means for rotating the wind direction shifting plate, there has been used a braking mechanism for controlling the rotating speed of the wind direction shifting plate so as to permit the wind direction shifting plate to be rotated at a low speed. In such arrangement, even if the wind direction shifting plate is forcibly stopped rotating by external force, it provokes no problems, but if such plate is forcibly rotated, there is a possibility of the braking mechanism being damaged.

In order to prevent damages to the motors, the reduction gear mechanism and the braking mechanism, there has been proposed an electric fan apparatus in which the rotary shaft of the braking mechanism or the speed reduction mechanism has been coupled to the wind direction shifting plate through clutch means. However, when such clutch means has been constituted by ball clutch means using springs and balls, such arrangement has presented defects that the number of parts to be used has been increased and the assembling work has been very difficult.

On the other hand, when the wind direction shifting plate has been rotated by the wind pressure and if symmetric portions of the wind direction shifting plate with respect to its rotating center have been unbalanced in weight, the rotating speed of the wind direction shifting plate has become uneven and therefore has not been smoothly rotated since the wind pressure exerted to the wind direction shifting plate has been constant at all times.

OBJECTS OF THE INVENTION

It is an object of the present invention to provide an electric fan apparatus in which the direction of a wind generated by the fan may continuously be changed at a low speed in a wide range including transverse and vertical directions.

It is another object of the present invention to provide an electric fan apparatus in which the wind direction shifting plate is rotated by the pressure of a wind generated by the fan without the use of the fan motor or other motors.

It is a further object of the present invention to provide an electric fan apparatus in which a speed governor mechanism to rotate the wind direction shifting plate at a low speed is housed in a housing box and such speed governor mechanism may stand the use for a long period of time without the necessity of adjustment thereof.

It is still another object of the present invention to provide an electric fan apparatus in which, even though the pressure of a wind generated by the fan is changed, the wind direction shifting plate may be rotated at a substantially constant low speed, by the fact that at least a portion of the gear mechanism to rotate the wind direction shifting plate at a low speed is immersed in a liquid contained in the housing box and therefore the resistance of such liquid becomes greater in proportion to the second power of the rotating speed of the gear mechanism.

It is a still further object of the present invention to provide an electric fan apparatus in which a blade is used as a portion of the gear mechanism, so as to apply a greater braking action to the wind direction shifting plate, thereby to rotate the wind direction shifting plate at a lower speed.

It is a still further object of the present invention to provide an electric fan apparatus in which stop-start means adapted to stop and start the rotation of the wind direction shifting plate comprises an engagement piece adapted to engage with one of the engagement portions formed at the outer periphery of the wind direction shifting plate, a spring for spring-loading such engagement piece in the engagement direction and an operating portion for holding such engagement piece at a shunting position against the spring-load of the spring, whereby the construction of the stop-start means for the wind direction shifting plate is simplified and the stop-start operation thereof may securely be performed, and the engagement piece may be engaged with one of the engagement portions merely by the spring-load of the spring, thereby to facilitate the mounting and removal of the wind direction shifting plate.

It is a still further object of the present invention to provide an electric fan apparatus in which the housing box which houses a gear mechanism and contains a liquid and through which the rotary shaft is projected, has, at a position therein other than that of the shaft hole of the rotary shaft, a concave portion into which the liquid is adapted to be gathered when the housing box is placed such that the rotary shaft is downwardly projected, whereby, when the electric fan apparatus in accordance with the present invention is unpacked or cleaned, namely, even though the housing box is placed for a long period of time in situations other than the usual using situation where the rotary shaft is horizontally projected, the liquid is at all times gathered into a place except for the shaft hole, thereby to prevent the liquid from flowing out through the shaft hole.

It is a still further object of the present invention to provide an electric fan apparatus in which clutch means comprising resilient claws and a concavo-convex portion is disposed between the wind direction shifting plate and the rotary shaft, whereby, even if the wind direction shifting plate is forcibly rotated by the hand, there is no possibility of a speed reduction mechanism or the like being damaged.

It is a still further object of the present invention to provide an electric fan apparatus in which the resilient claws are formed in the triangle frame shape and connected to a boss in a unitary construction through thin members, whereby, when external force is exerted to the wind direction shifting plate, the triangle frame claws become easily flat and inclined, and are disengaged from the concavo-convex portion, so that even though external force is exerted to the wind direction shifting plate either in the right or left direction, the speed reduction mechanism or the like may securely be protected, and when the wind direction shifting plate is removed, there is no possiblity of the clutch means comprising the resilient claws and the concavo-convex portion being removed, and when the wind direction shifting plate is removed or attached, the clutch means is never damaged.

It is a still further object of the present invention to provide an electric fan apparatus in which the wind direction shifting plate has a plurality of wind direction shifting vanes in parallel with each other and such wind direction shifting vanes are inclinedly formed such that their inclinations are changed in succession from one end vane to the other end vane thereof, and the rotating center of the wind direction shifting plate is identical with the gravity center thereof, whereby the wind direction shifting plate may smoothly be rotated at a constant speed and the air sending direction may smoothly be changed.

It is a still further object of the present invention to provide an electric fan apparatus in which the gear mechanism is provided at the last stage thereof with an escape wheel and a balance, thereby to rotate the wind direction shifting plate at a constant speed.

BRIEF DESCRIPTION OF THE DRAWINGS

The present invention will become more fully understood from the detailed description given hereinbelow and the accompanying drawings which show embodiments of the present invention by way of example only, and wherein.

DETAILED DESCRIPTION OF THE PREFERRED EMBODIMENTS

Figure 1:
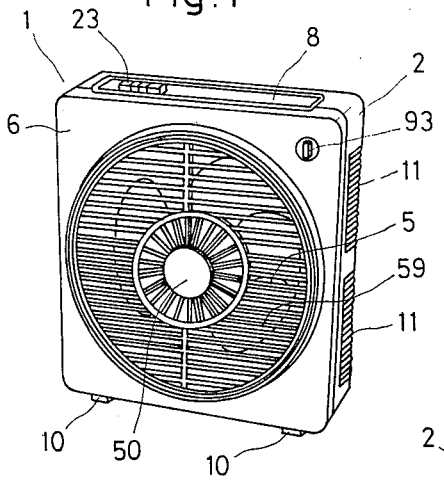
FIG. 1 is a perspective view of an embodiment of an electric fan apparatus according to the present invention.
Figure 2:
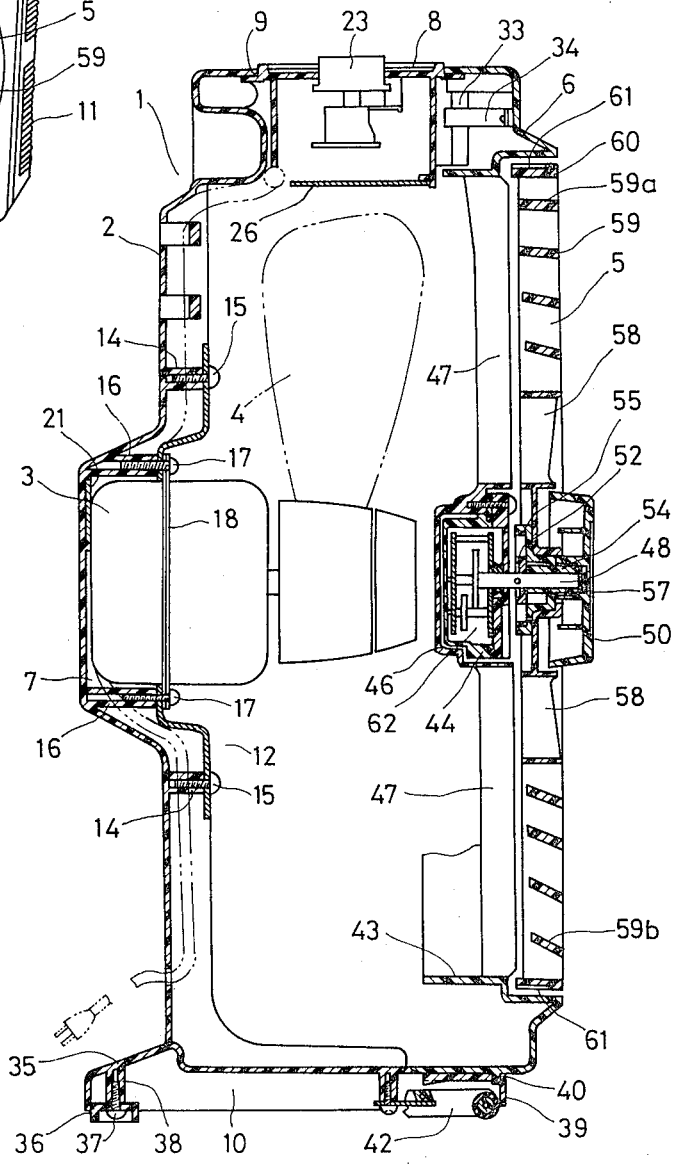
FIG. 2 is a side sectional view of the electric fan apparatus in FIG. 1.
Figure 3:
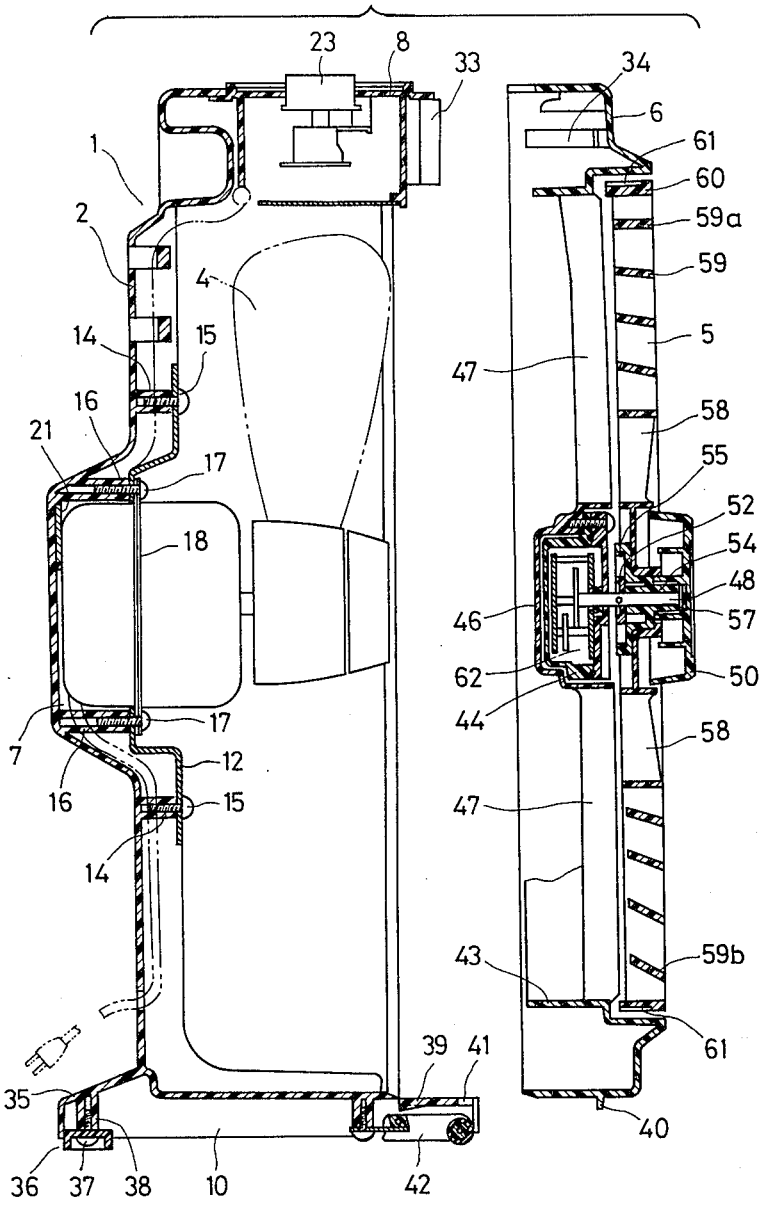
FIG. 3 is a side sectional view with the front frame removed, of the electric fan apparatus in FIG. 1.
Figure 4:
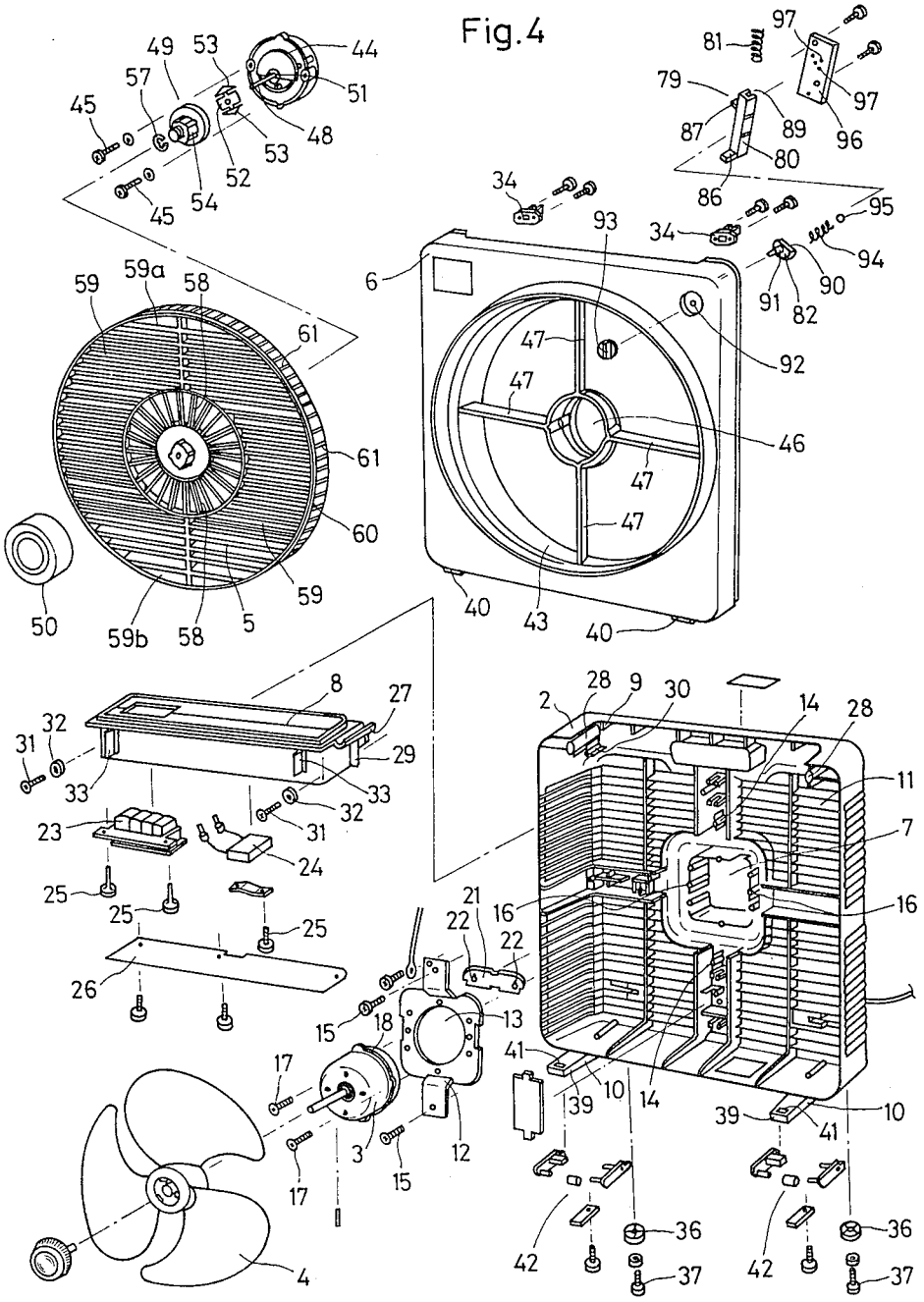
FIG. 4 is a disassembled perspective view of the electric fan apparatus in FIG. 1.
Figure 5:
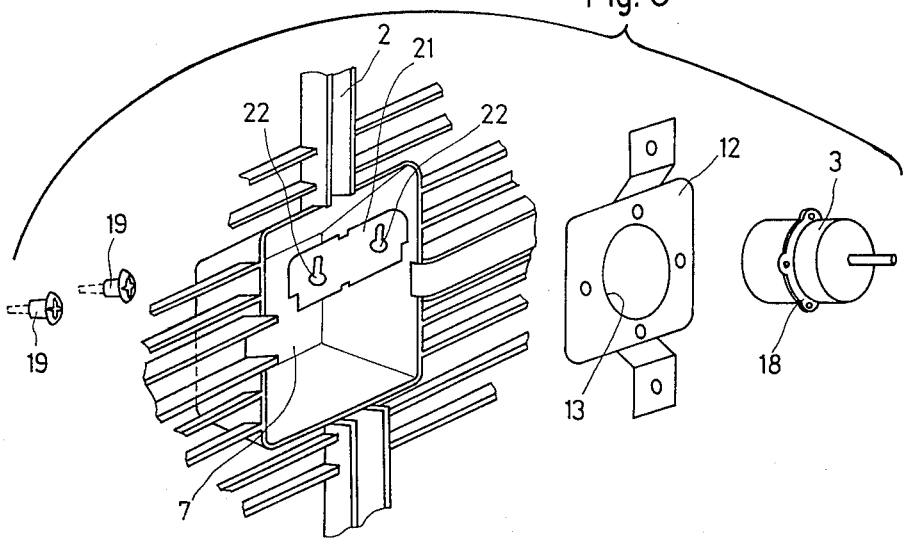
FIG. 5 is a disassembled perspective view showing the motor mounting parts of the electric fan apparatus in FIG. 1.
Figure 6:
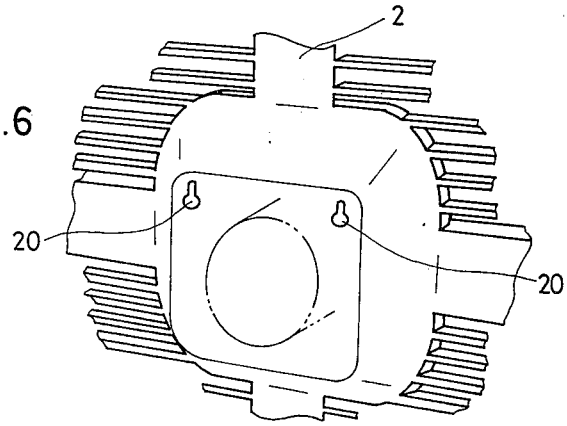
FIG. 6 is a perspective view of the motor mounting concave portion when viewed from the back side of the electric fan apparatus in FIG. 1.
Figure 7:
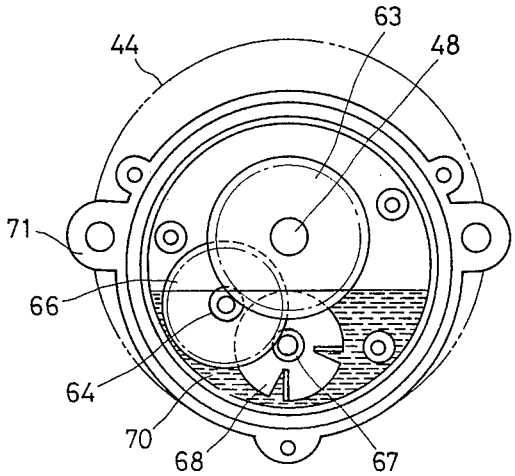
FIG. 7 is a front view showing the gear mechanism housed in a housing box of the electric fan apparatus in FIG. 1.
Figure 8:
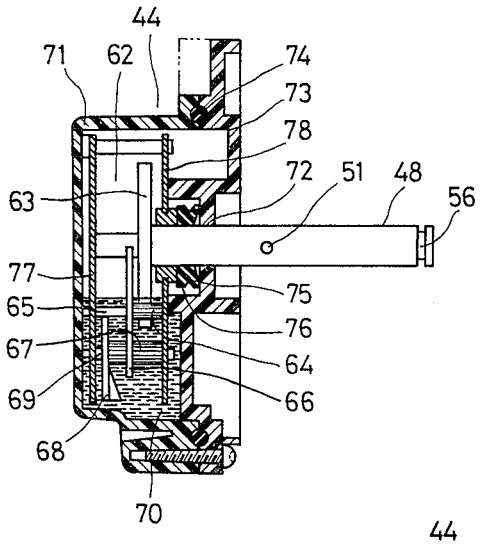
FIG. 8 is a sectional view of the housing box.
Figure 9:
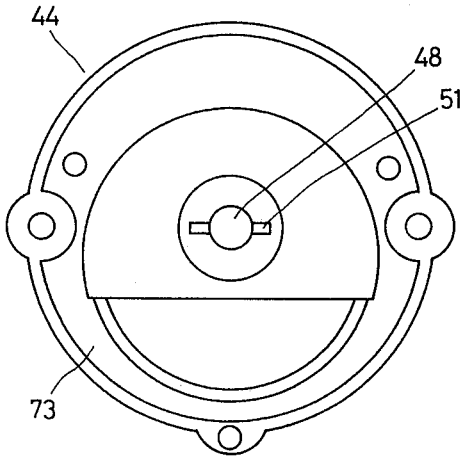
FIG. 9 is a front view of FIG. 8.
Figure 10:
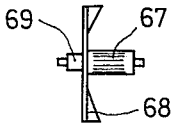
FIG. 10 is a side view of the last stage gear in the gear mechanism.
Figure 11:
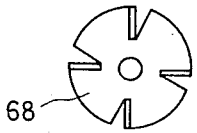
FIG. 11 is a front view of FIG. 10.
Figure 12:
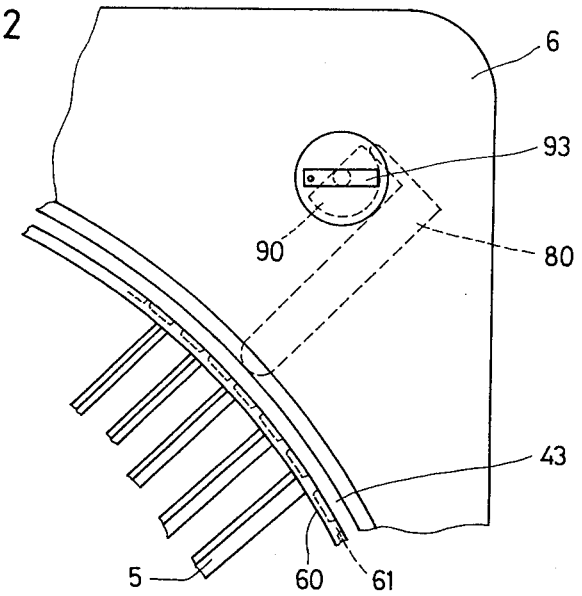
FIG. 12 is a front view of stop-start means used in the electric fan apparatus in FIG. 1.
Figure 13:
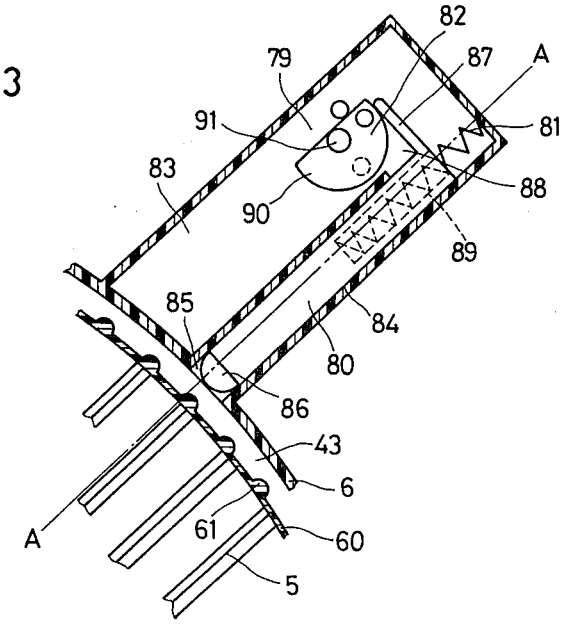
FIG. 13 is a front sectional view of FIG. 12.
Figure 14:
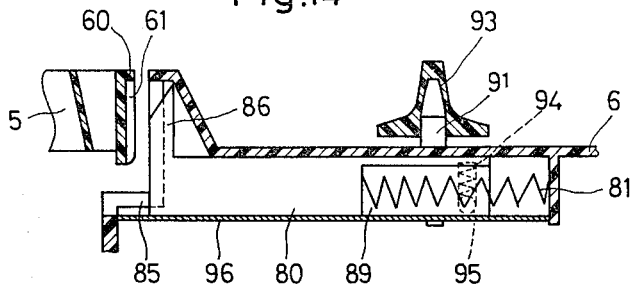
FIG. 14 is a sectional view taken along the line A—A in FIG. 13.
Figure 15:
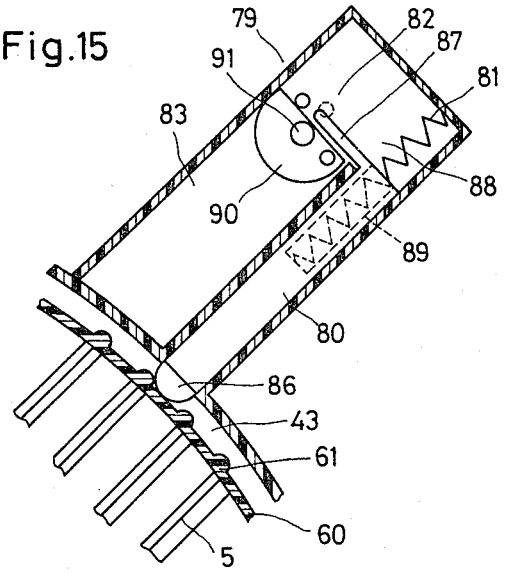
FIG. 15 is a view similar to FIG. 13, with the wind direction shifting plate stopped rotating.
Figure 16:
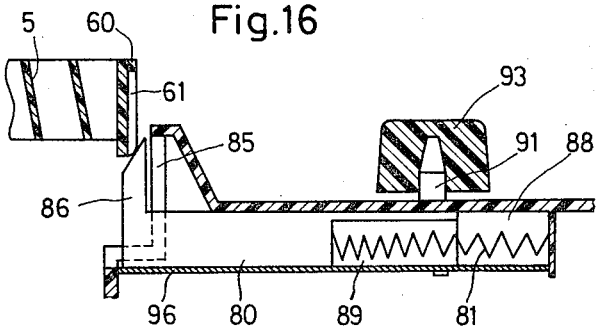
FIG. 16 is a view similar to FIG. 14, with the wind direction shifting plate being mounted.

The description hereinbelow will discuss an embodiment of an electric fan apparatus in accordance with the present invention, by referring to FIGS. 1 to 16.

In an electric fan apparatus 1, a motor 3 and a fan 4 are incorporated in a casing 2, and a front frame 6 by which a wind direction shifting plate 5 is pivotally supported, is removably mounted to the casing 2 at the opening formed at the air sending side thereof. The casing 2 is provided at the center thereof with a motor mounting concave 7, at the top surface thereof with a notch 9 to which a housing case 8 for housing a switch or the like is fitted, at the bottom thereof with leg members 10 for supporting the casing 2 in a stable manner and at the rear side surface thereof which air intake grilles 11.

A motor supporting plate 12 has therein a motor fitting opening 13 and is fixed, with screws 15, to bosses 14 projectingly disposed at the periphery of the motor mounting concave 7.

After the rear half of the motor 3 has been fitted into the motor fitting opening 13, the motor supporting plate 12 and the flange 18 of the motor 3 are fixed, with screws 17 at the same time, to bosses 16 projectingly disposed in the motor mounting concave 7, so that the motor 3 is mounted to the casing 2.

The motor mounting concave 7 is provided at the upper corners of the back wall thereof with wall hanging holes 20 in the keyhole shape, by which the heads of screws 19 threadedly inserted into a room wall, are to be insertedly held.

A reinforcing plate 21 is held by and between the rear face of the motor 3 and the back wall of the motor mounting concave 7, and has therein holes 22 similar to the wall hanging holes 20.

The housing case 8 has a lower end opening, which is closed by a back lid 26 after a switch 23 and a condenser 24 have been fixed into this housing case 8 with screws 25. The housing case 8 is mounted to the casing 2 in the following manner: ribs 27 disposed at the both upper edges of the case 8 are inserted into and held by holding portions 28 formed adjacent to the both lateral ends of the notch 9, so that the housing case 8 is fixed to the casing 2 in the vertical direction, and ribs 29 projected from the innermost corners of the both lateral sides of the case 8 are fixed with screws 31 and washers 32 to bosses 30 projected from the casing 2, so that the housing case 8 is fixed to the casing 2 in the transverse direction.

The housing case 8 is provided at the front side thereof with a pair of engagement projections 33 in a unitary construction with the housing case 8. These engagement projections 33 are engaged with engagement members 34 formed at the upper inside of the front frame, thereby to hold the upper portion of the front frame 6.

Formed as if projecting from the casing 2, the leg members 10 are long enough in the forth and back direction. Their rear ends 35 project so as to align with the rear surface of the back wall of the motor mounting concave 7. Thus, the rear ends 35 of the leg members 10 will serve as lower supports when the electric fan apparatus 1 is used as hung up on a wall. Fixed at the lower surface of the rear ends 35 are resilient members 36 adapted to come in contact with a floor when the electric fan apparatus in accordance with the present invention is used as placed on the floor. These resilient members 36 are fixed to bosses 38 with screws 37.

The leg members 10 are provided at the upper surface of the front ends 39 thereof with engagement holes 41 to holdingly engage with engagement tongue pieces 40 formed at the bottom of the front frame 6. The leg members 10 are also provided at the lower surface of the front ends 39 with leg pieces 42, which may be raised up in a pivotal manner. When these leg pieces 42 are raised up, the electric fan apparatus 1 is slightly turned upwardly, thereby to permit the air sending center to be changed.

At the front frame 6, the wind direction shifting plate 5 is located and a wind tunnel 43 is formed for efficiently sending a wind generated by the fan 4. Disposed at the center of the wind tunnel 43 is a mounting member 46 for fixing a housing box 44 with screws 45, and this mounting member 46 is formed integrally with supporting members 47 extending into the wind tunnel 43.

The wind direction shifting plate 5 is mounted to a rotary shaft 48 projected from the housing box 44, with a spinner 50 through clutch means 49. The clutch means 49 comprises resilient claws 53 formed in the triangle frame shape and a concavo-convex portion 55 adapted to engage with the claws 53. The triangle frame shape resilient claws 53 are formed integrally with an engagement boss 52 which is engaged with a pin 51 attached to the rotary shaft 48. The concavo-convex portion 55 is formed at a connecting member 54 with which the wind direction shifting plate 5 is engaged and which is fixed with the spinner 50 and is pivoted to the rotary shaft 48. In order to prevent the connecting member 54 from coming out from the rotary shaft 48, a coming-out prevention ring 57 is mounted to an annular groove 56 formed in the tip of the rotary shaft 48.

Figure 23:
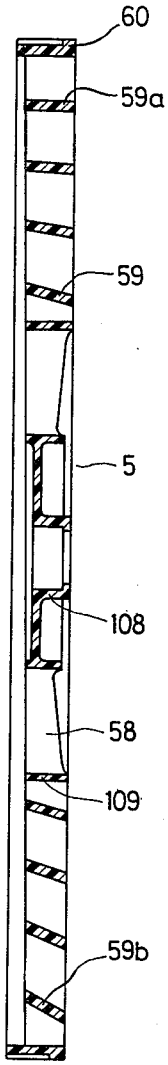
FIG. 23 is a side sectional view of a first embodiment of the wind direction shifting plate used in the electric fan apparatus according to the present invention.
Figure 25:
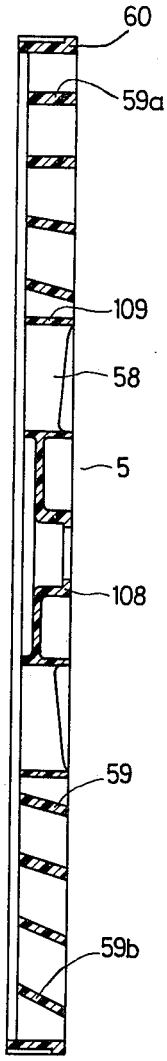
FIG. 25 is a side sectional view of a second embodiment of the wind direction shifting plate.

The wind direction shifting plate 5 is provided at the center thereof with radially projecting straightening vanes 58 and at the outside of these straightening vanes 58 with wind direction shifting vanes 59. These wind direction shifting vanes 59 are inclinedly formed such that greater inclination is provided thereto in the direction from the uppermost vane **59*a* toward the lowermost vane 59*b* as shown in FIGS. 23 and 25. The widthes of the wind direction shifting vanes 59 are all identical with each other so as to keep weight balance of the wind direction shifting plate 5. Formed at the outer periphery 60 of the wind direction shifting plate 5 are engagement portions 61** with which stop-start means to be discussed is adapted to be engaged.

Housed in the housing box 44 is a gear mechanism 62 adapted to be rotated interlockingly with the rotation of the wind direction shifting plate 5. This gear mechanism 62 comprises a first gear 63 to be rotated around and integrally with the rotary shaft 48, a first coupling gear 64 to mesh with the first gear 63, a second gear 66 to be rotated integrally with and around a rotary shaft 65 around which the first coupling gear 64 is also rotated, and a second coupling gear 67 to mesh with the second gear 66.

A blade 68 is rotated integrally with and around a rotary shaft 69 around which the second coupling gear 67 is rotated. This blade 68 may be formed from a circular sheet metal with sector-shape portions thereof cut and raised up, or may be made of a synthetic resin.

Contained in the housing box 44 is a liquid 70 having a certain degree of viscosity, such as oil and grease, in which the blade 68, the second coupling gear 67, the first coupling gear 64, the lower portion of the second gear 66 and the lower portion of the first gear 63 are immersed. The housing box 44 comprises a box main body 71 and a lid member 73 having therein a shaft hole 72 through which the rotary shaft 48 is projected. The box main body 71 and the lid member 73 are hermetically sealed to each other with a ring-shape packing 74. In order to hermetically sealed the rotary shaft 48 to the shaft hole 72, a V-shape ring 76 is used. This V-shape ring 76 has a lip portion 75 to come in contact with the periphery of the shaft hole 72 in a resilient manner. The rotary shafts 48, 65 and 69 are pivotally supported by the supporting plates 77 and 78.

When the motor 3 is driven to rotate the fan 4, the wind direction shifting plate 5 will be apt to rotate at a high speed in synchronous with the rotation of the fan 4 due to the pressure of a wind generated by the fan 4. The rotation of the wind direction shifting plate 5 will be transmitted to the gear mechanism 62, in which the gears 63, 64, 66 and 67 and the blade 68 will also be apt to rotate. However, since the gears 63, 64, 66 and 67 and the blade 68 are immersed in the liquid 70, the liquid 70 serves as resistance against the gears 63, 64, 66 and 67 which are apt to rotate at a high speed, so that a braking action will be applied to these gears 63, 64, 66 and 67 and the blade 68. Since such braking action will become greater in proportion to the second power of the rotation speed of the gear mechanism, the rotation of the wind direction shifting plate 5 will be decreased to a substantially constant low speed, regardless of the rotating speed of the fan motor 3.

The stop-start means 79 is mounted to the front frame 6 and adapted to stop and start the rotation of the wind direction shifting plate 5. This stop-start means 79 comprises an engagement piece 80 adapted to engage with one of the engagement portions 61 of the wind direction shifting plate 5, a spring 81 to apply spring-load to this engagement piece 80 in the engagement direction, and an operating portion 82 to hold the engagement piece 80 at a shunting position against the spring-load of the spring 81. This stop-start means 79 is mounted to a housing portion 83 formed at the front frame 6.

Formed in the housing portion 83 is a groove 84 to slidably hold the engagement piece 80. Formed at one end of the groove 84 is a through-hole 85 communicated with the wind tunnel 43, into which an engagement portion 86 formed at one end of the engagement piece 80 is projected. Formed at the other end of the groove 84 is a notch 88, through which an operating rod 87 projected from the other end of the engagement piece 80 is projected into the housing portion 83.

A groove 89 for holding and housing one half of the spring 81 is formed in the other end of the engagement piece 80. The other half of the spring 81 is projected into the housing portion 83, of which inner wall presses the end of said other half of the spring 81.

When the engagement piece 80 is spring-loaded by the spring 81 and the engagement portion 86 is projected into the wind tunnel 43, the operating rod 87 will come in contact with the end edge of the notch 88, so that the wind direction shifting plate 5 will be fixed at a desired position.

A cam plate 90 will cause the operating rod 87 to be moved against the spring, and the engagement piece 80 to be held at the shunting position.

A rotary shaft 91 to rotatingly operate this cam plate 90 is projected from the front surface of the front panel 6 through a bearing hole 92 formed in the front panel 6. An operation knob 93 is fixed at the end of this rotary shaft 91.

Housed in the cam plate 90 is a clutch ball 95 to be outwardly spring-loaded by a spring 94. This clutch ball 95 is adapted to selectively engage with either one of engagement holes 97 formed in a lid 96 which closes the housing portion 83, thereby to hold the cam plate 90 either at the position where the operating rod 87 is to be moved, or the position where the cam plate 90 does not come in contact with the operating rod 87.

Accordingly, when the engagement piece 80 is being projected in the wind tunnel 43, it means this engagement piece 80 is merely spring-loaded by the spring 81 and is therefore easily retracted if pushed from the wind tunnel side. The wind direction shifting plate 5 may therefore be removed without any resistance when it is stopped rotating. When intending to mount the wind direction shifting plate 5, even though one of the engagement portions 61 engages with the engagement piece 80, the engagement piece 80 may be retracted by pushing the wind direction shifting plate 5, so that the wind direction shifting plate 5 may be attached without any resistance.

As thus discussed hereinbefore, in the embodiment shown in FIGS. 1 to 16 of the electric fan apparatus according to the present invention, the direction of a wind generated by the fan 4 may be changed at a low speed in a wide range, and the speed governor mechanism such as the gear mechanism 62 to rotate the wind direction shifting mechanism 5 at a low speed is housed in the housing box 44, thereby to enable the electric fan apparatus to be used for a long period of time in good order.

In addition, since at least a portion of the gear mechanism 62 is immersed in the liquid 70 enclosed in the housing box 44, such liquid 70 applies to the wind direction shifting plate 5 a great braking action in proportion to the second power of the rotating speed of the gear mechanism 62, thereby to permit the wind direction shifting plate 5 to be rotated at a substantially constant low speed, even though the pressure of a wind generated by the fan 4 is changed.

Furthermore, the stop-start means 79 is simplified in construction and the stop-start operation thereof may securely be performed, and the wind direction shifting plate 5 may readily be removed and attached.

Figure 17:
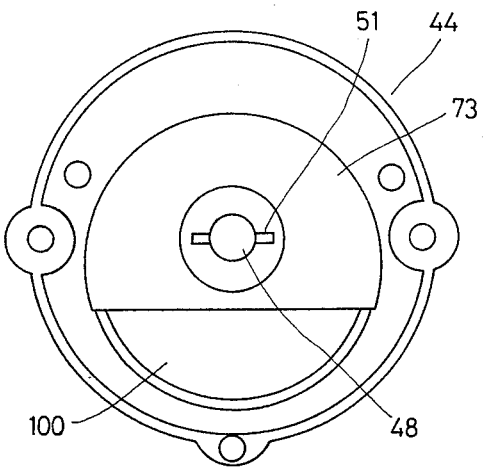
FIG. 17 is a front view of the housing box.
Figure 18:
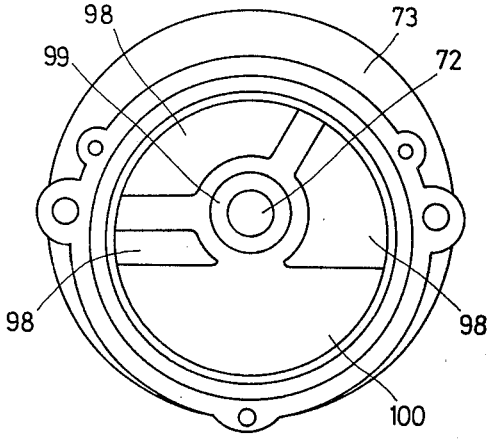
FIG. 18 is a rear view of the lid of the housing box.
Figure 19:
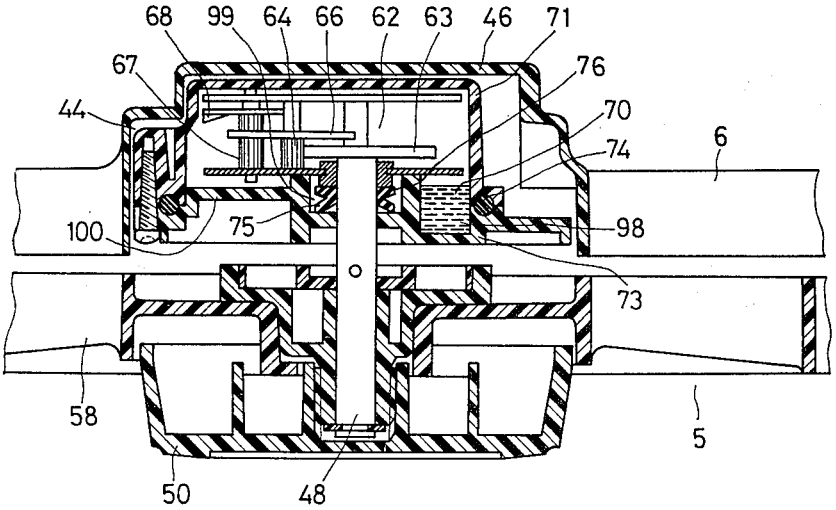
FIG. 19 is a front sectional view of the housing box with the front frame placed on a floor.

The description hereinbelow will discuss in more detail the housing box 44 with reference to FIGS. 17 to 19.

Formed in the inner surface of the lid member 73 of the housing box 44 is a concave portion 98 in which the liquid 70 is adapted to be gathered when the housing box 44 is placed such that the rotary shaft 48 is downwardly projected. This concave portion 98 is formed at other position than the position of a concave portion 99 around the shaft hole 72. At the inner surface of the lid member 73, a semicircle convex portion 100 is formed, thereby to reduce the necessary amount of the liquid 70. Accordingly, when the present electric fan apparatus is placed on a floor with the front frame 6 removed and the spinner 50 turned downwardly, the liquid 70 is gathered in the concave portion 98 and therefore the shaft hole 72 is never immersed into the liquid 70. Subsequently, even if the present electric fan apparatus is placed on the floor in such a situation for a long period of time, the liquid 70 never oozes out between the ring 76 and the periphery of the shaft hole 72, thereby to prevent the liqud 70 from flowing out.

Figure 20:
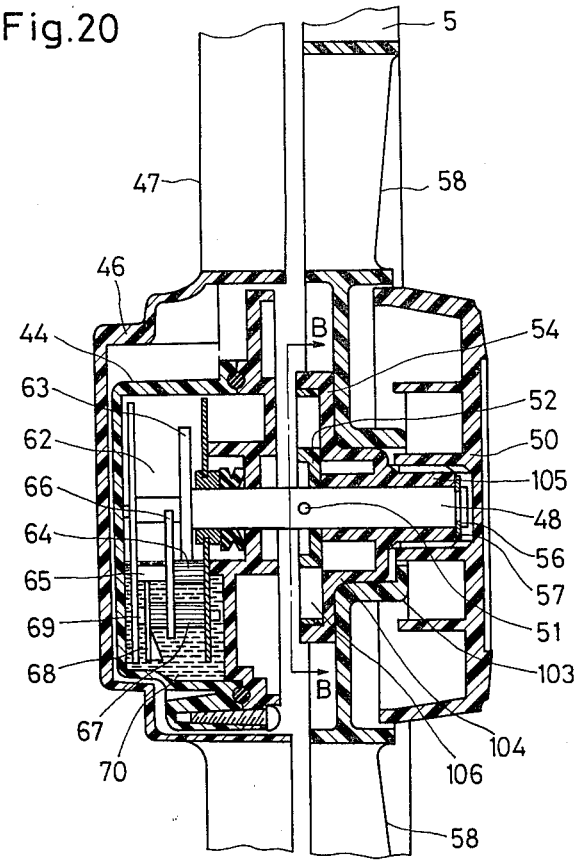
FIG. 20 is a sectional view of the portions of mounting the wind direction shifting plate.
Figure 21:
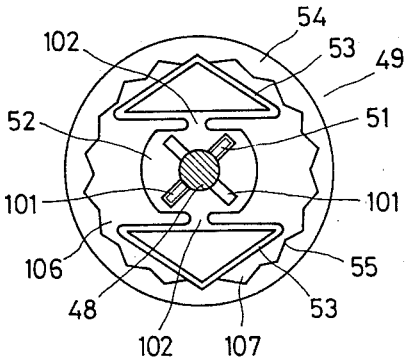
FIG. 21 is a sectional view taken along the line B—B in FIG. 20.
Figure 22:
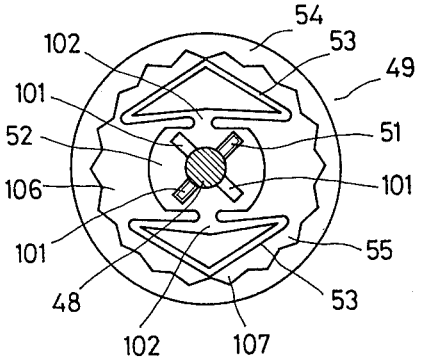
FIG. 22 is a sectional view similar to FIG. 21, showing clutch means which is being declutched.

The description hereinbelow will discuss the clutch means 49 in more detail with reference to FIGS. 20 to 22.

The engagement boss 52 made of a synthetic resin has engagement grooves 101 adapted to engage with the pin 51 attached to the rotary shaft 48. The triangle frame shape resilient claws 53 are formed at this boss 52 in a unitary construction through thin connecting portions 102. The connecting member 54 pivotedly supported by the rotary shaft 48 has an engagement portion 104 with which the boss 103 of the wind direction shifting plate 5 is engaged. Also, the connecting member 54 has a threaded portion 105, into which the spinner 50 is threadedly inserted in order to prevent the wind direction shifting plate 5 from coming out. Furthermore, the connecting member 54 has a concave portion 106 for housing the boss 62 and the claws 53. The concavo-convex portion 55 adapted to engage with the claws 53 is formed at the peripheral wall of this concave portion 106. Thus, the clutch means 49 is constituted by the claws 53 and the concavo-convex portion 55.

The concave parts 107 of the concavo-convex portion 55 are formed in the shape identical with that of the tip of each claw 53. Accordingly, when force apt to forcibly rotate the wind direction shifting plate 5 is applied thereto, the claws 53 become flat and are bent with the thin connecting portions 102 as a fulcrum, so that the claws 53 disengage from the concavo-convex portion 55 and new engagement is subsequently provided. Namely, when external force is applied to the wind direction shifting plate 5, the claws 53 disengage from the concavo-convex portion 55 and no external force is therefore transmitted to the gear mechanism 62. It means that the gear mechanism 62 is never damaged.

The description hereinbelow will discuss various embodiments of the wind direction shifting plate 5 with reference to FIGS. 23 to 28.

In FIGS. 23 to 28, the wind direction shifting plate 5 is provided at the center thereof with a mounting boss 108 which is mounted to the rotary shaft 48 with the spinner 50. The radially extending straightening vanes 58 are disposed between the boss 108 and an annular intermediate partition rib 109. In addition, the inclined wind direction shifting vanes 59 are disposed in parallel with each other between the annular intermediate partition rib 109 and an annular outer peripheral rib 60. These wind direction shifting vanes 59 are coupled to a reinforcing rib 110, which extends in the diametrical direction of the wind direction shifting plate 5 and at right angles to the wind direction shifting vanes 59.

The description hereinbelow will discuss an embodiment of the wind direction shifting plate 5 with reference to FIGS. 23 and 24.

Each of the outer peripheral rib 60 and the annular intermediate partition rib 109 is formed in a whole circle shape and has a fixed depth (L) and a fixed thickness (t), respectively. The wind direction shifting vanes 59 are inclinedly formed such that greater inclination is provided thereto in the direction from the uppermost vane 59*a* to the lowermost vane 59*b* as shown in FIG. 23, and such that the sectional areas of the wind direction shifting vanes 59 are same to each other.

Figure 24A:
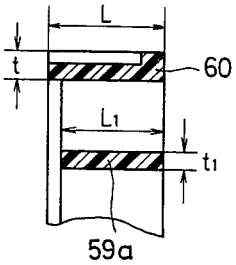
FIG. 24 (A) and (B) are enlarged views of portions in FIG. 23.
Figure 24B:
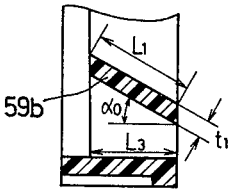

The wind direction shifting vanes 59 have a smaller depth from $L_1$ to $L_3$ as their inclination becomes greater as shown in FIG. 24, but have a fixed width ($L_1$) and a fixed thickness ($t_1$), regardless of the inclination of each wind direction shifting vane 59.

Accordingly, the respective weights of symmetric portions of the wind direction shifting plate with respect to the rotation center thereof are identical with each other. Therefore, the wind direction shifting plate 5 is formed as balanced in weight, thus requiring no additional adjustment of the weight balance, whereby such wind direction shifting plate 5 may be formed easily and economically.

Figure 26A:
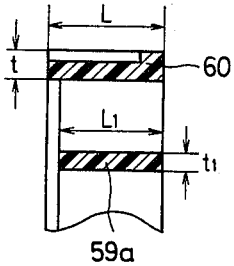
FIG. 26, (A) and (B) are enlarged views of portions in FIG. 25.
Figure 26B:
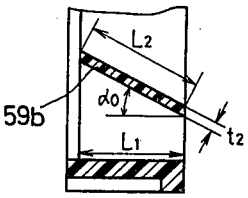

The description hereinbelow will discuss another embodiment of the wind direction shifting plate 5 with reference to FIGS. 25 to 26.

In order to provide an identical sectional area to each of the wind direction shifting vanes 59, as their inclination becomes greater the wind direction shifting vanes 59 have a thinner thickness from $t_1$ to $t_2$ and a larger width from $L_1$ to $L_2$ with their depth ($L_1$) being fixed.

Figure 27:
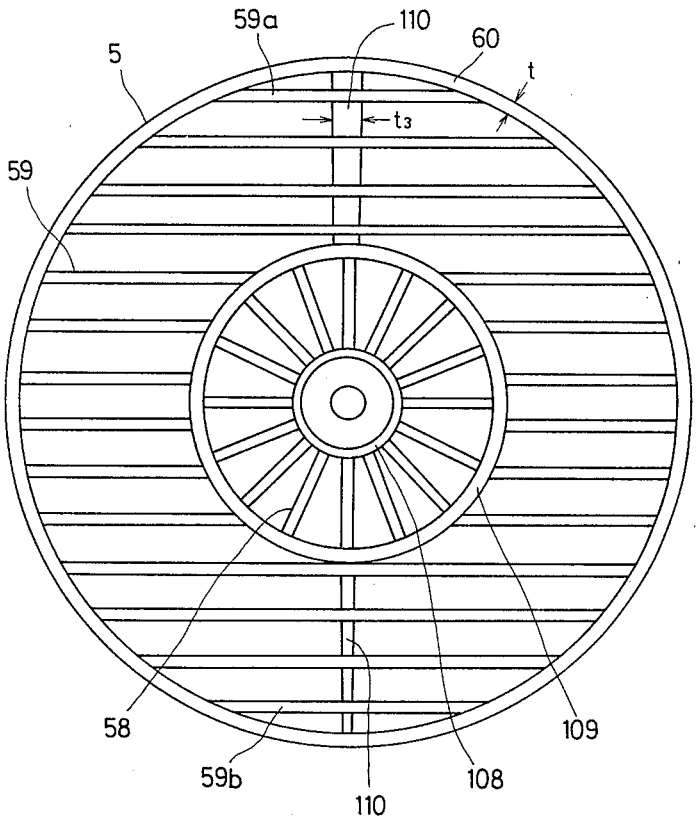
FIG. 27 is a front view of a third embodiment of the wind direction shifting plate.
Figure 28:
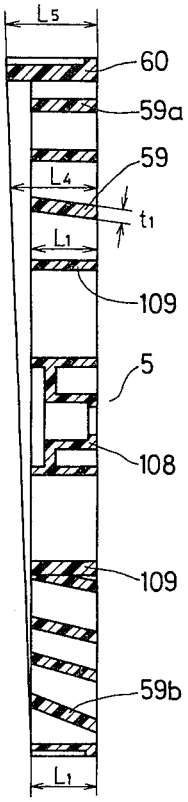
FIG. 28 is a side sectional view of the wind direction shifting plate in FIG. 27.

The description hereinbelow will discuss still another embodiment of the wind direction shifting plate 5 with reference to FIGS. 27 to 28.

In this case, the wind direction shifting vanes 59 have a fixed depth $L_1$ and a fixed thickness $t_1$, and the depths of the outer periphery 60 of the wind direction shifting plate 5 are shortened from $L_5$ to $L_1$ and the thicknesses $t_3$ of the reinforcing rib 110 are changed, so as to adjust the weight balance of the wind direction shifting plate 5.

Figure 29:
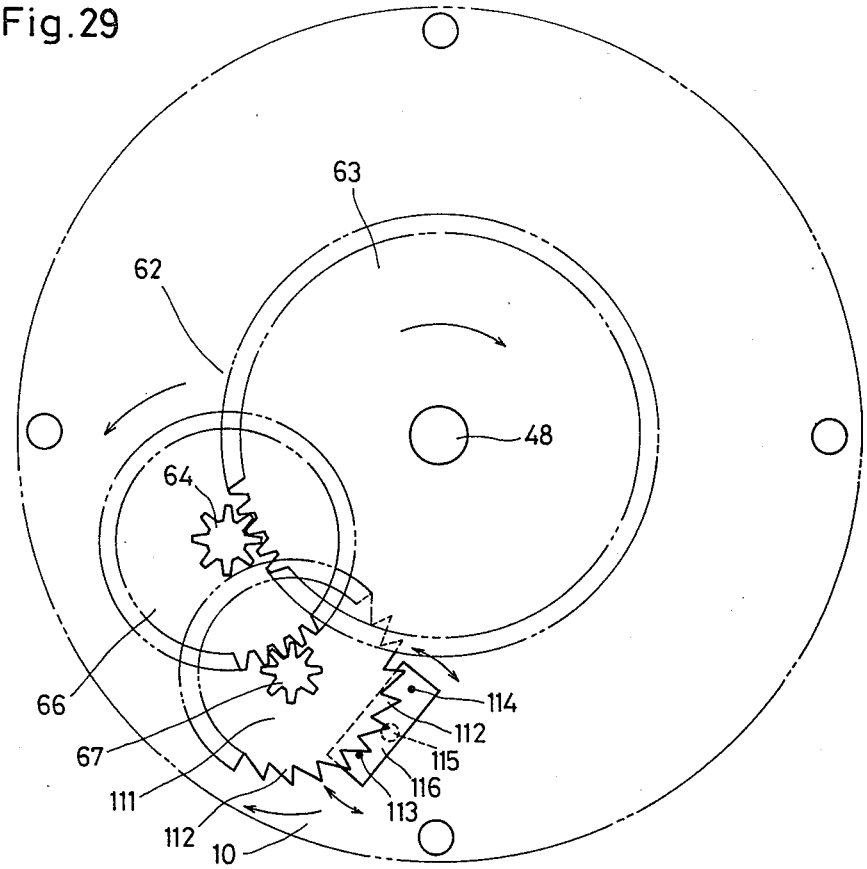
FIG. 29 is a front view of a gear mechanism in another form used in the electric fan apparatus according to the present invention.
Figure 30:
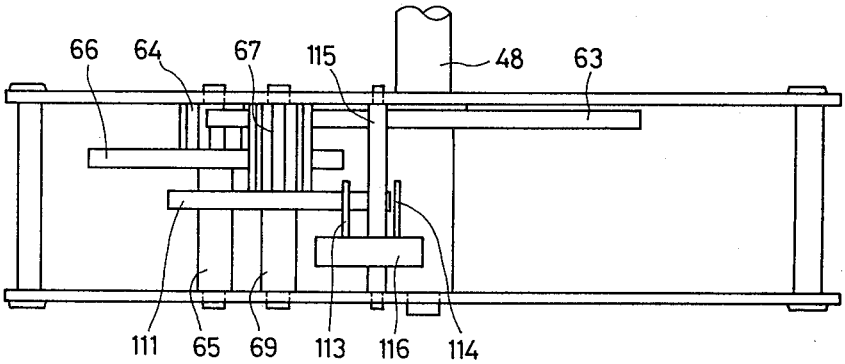
FIG. 30 is a side view of the gear mechanism in FIG. 29.

The description hereinbelow will discuss other embodiment of the gear mechanism with reference to FIGS. 29 to 30.

According to this embodiment, disposed in the gear mechanism 62 mentioned earlier are an escape wheel 111 to be rotated around and integrally with the rotary shaft 69 around which the second coupling gear 67 is rotated, and a balance 116 which is provided with projecting pins 113 and 114 to be alternately caught by the teeth 112 of the escape wheel 111 and which is vibrated with a shaft 115 as fulcrum.

In such an arrangement, the rotation of the wind direction shifting plate 5 is transmitted to the escape wheel 111 through the gear mechanism 62 and subsequently the escape wheel 111 is rotated. However, the pin 113 of the balance 116 is caught by one of the teeth 112 of the escape wheel 111 is temporarily stopped. Thereafter, the rotation of the escape wheel 111 causes the pin 113 to be disengaged from said one of the teeth 112 as if pushed out, and at the same time the balance 116 is swung with the shaft 115 as fulcrum and the other pin 114 is caught by other one of the teeth 112, thereby to stop temporarily the rotation of the escape wheel 111. Thus, with the shaft 115 as fulcrum, the balance 116 is vibrated by the fact that the pins 113 and 114 are pushed out from the teeth 112 by the rotation of the escape wheel 111. Accordingly, the escape wheel 111 is fed and rotated by a half of one tooth at a speed synchronous with the number of vibrations of the balance 116. Thus, by the rotation of the escape wheel 116 at a constant speed a braking action is applied to the wind direction shifting plate 5 through the gear mechanism 62, whereby the wind direction shifting plate 5 is rotated at a constant low speed.

What we claim is:

1. An electric fan apparatus comprising:

a fan;

a wind direction shifting plate disposed in front of said fan and being rotatable by wind generated thereby; and stop-start means for stopping and starting rotation of said wind direction shifting plate, said stop-start means comprising an engagement piece adapted to engage with one of a plurality of engagement portions formed on an outer periphery of said wind direction shifting plate, a spring urging said engagement piece in a direction to engage with one of said plurality of engagement portions and an operating portion for holding said engagement piece at a shunting position against force exerted by said spring.

2. An electric fan apparatus as set forth in claim 1, wherein said operating portion comprises an operating rod projected from and integrally with said engagement piece and a cam plate for moving and operating said operating rod against said spring.

* * * * *